United States Patent [19]

Courtman

[11] Patent Number: 4,607,756

[45] Date of Patent: Aug. 26, 1986

[54] CONTAINER

[75] Inventor: Murray G. Courtman, Auckland, New Zealand

[73] Assignee: Brent William Gibson, Auckland, New Zealand

[21] Appl. No.: 677,734

[22] Filed: Dec. 3, 1984

[30] Foreign Application Priority Data

Dec. 5, 1983 [NZ] New Zealand ..... 206480

[51] Int. Cl.[4] ..... B65D 1/04

[52] U.S. Cl. ..... 215/6; 220/20; 206/581

[58] Field of Search ..... 215/6; 220/20; 206/581

[56] References Cited

U.S. PATENT DOCUMENTS

| | | | |
|---|---|---|---|
| 4,078,686 | 3/1978 | Karesh | 215/6 |
| 4,113,097 | 9/1978 | Finn | 215/6 |
| 4,363,479 | 12/1982 | Urasaki | 215/6 |
| 4,444,324 | 4/1984 | Grenell | 215/6 |

*Primary Examiner*—Joseph Man Fu Moy

*Attorney, Agent, or Firm*—Holman & Stern

[57] ABSTRACT

A container includes at least two integrally formed but separate, spaced end to end chambers provided one above the other, each chamber having a separate opening. The chambers are substantially co-axial and may be substantially the same size or different sizes.

7 Claims, 6 Drawing Figures

CONTAINER

BACKGROUND OF THE INVENTION

1. Field of the Invention

This invention relates to a container.

2. Description of the Prior Art

Up until this time, numerous containers have been provided for matter such as for example liquids or flowable matter. For example containers have been provided for hair shampoo, hair conditioners, liquid skin preparations, preparations for treatment of the hair, cosmetics, medicaments, pharmaceuticals, cleaning liquids and the like. Up until this time, various containers have been provided, many of which have been formed or moulded out of a plastics material, and which are elongate in formation, being provided at one end thereof with an outlet portion which usually engages with a screw thread or a "clip-on" or "snap-on" cap or closure.

In that numerous products are sold in such containers, it is often a problem, that when a user or purchaser wishes to use or purchase a number of products for use at or about the same time, it is necessary to purchase a plurality of different containers. Thus, it is also necessary to store and carry around a plurality of containers. By way of example, hair shampoo and hair conditioner, which are usually used at or about the same time, are sold in separate containers. Thus, it is necessary to purchase, and store, two separate containers. When a user is washing hair, or is having a bath or shower, it is also necessary to have two separate containers adjacent the person, so that a shampoo can firstly be used and thereafter a shampoo. It is also envisaged that there are other circumstances where two or more products are required to be used at or about the same time and where the same basic problem is likely to arise.

Where a person is travelling or moving from place to place, the plurality of containers required represents a problem or difficulty in so far as travel, packing and storage is concerned.

It is an object of this invention to attempt to provide a container, which minimizes or overcomes these problems.

Further objects of this invention will become apparent from the following description.

SUMMARY OF THE INVENTION

According to one aspect of the invention, there is provided a container comprising at least two integrally formed but separate end on end chambers, at least one chamber being provided above another and each chamber being provided with a separate opening the chambers being separated one from the other by a mouth portion defining an at least partial spacing beween the chambers, the mouth portion defining an open face between the end on end chambers and a rear joining wall of the container, upper and lower faces of the mouth portion defining respectively, lower and upper ends of spaced-apart upper and lower chambers of the container.

According to a further aspect of this invention the end on end chambers are substantially co-axial.

BRIEF DESCRIPTION OF THE DRAWINGS

This invention will now be described by way of example only, and with reference to the accompanying drawings, wherein.

DESCRIPTION OF THE PREFERRED EMBODIMENT

Figure 1:
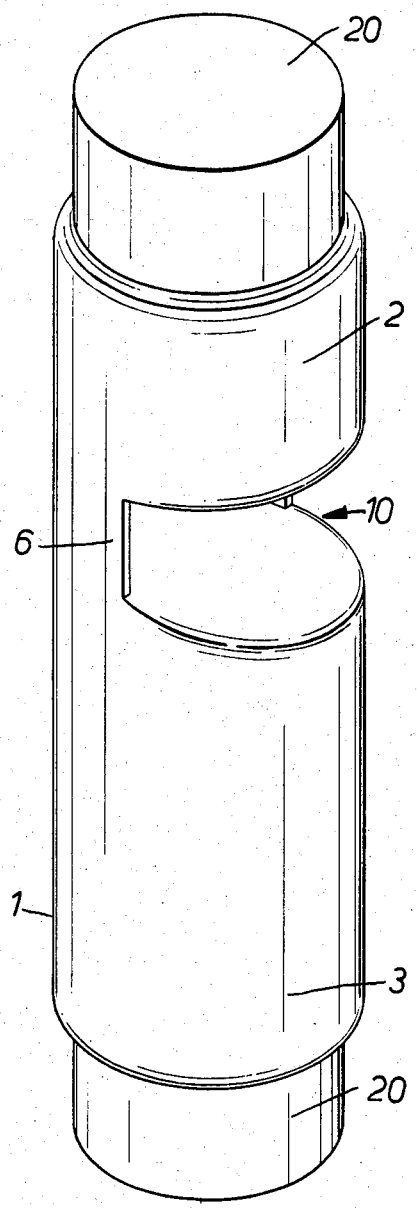
FIG. 1 is a perspective view of a container according to one form of the present invention.
Figure 2:
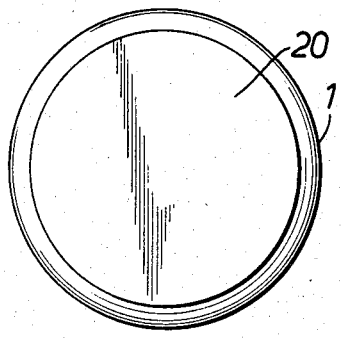
FIG. 2 is a top or bottom plan view of FIG. 1.

As referred to hereinbefore, it has been a problem up until this time that numerous products which are usually used or sold together, are sold in separate containers. In many cases, this duplicates or at least increases costs and also contributes to inefficiencies. It also causes problems in so far as carrying, storage and use are concerned. The present invention sets out to overcome or at least minimize these problems by providing a container which includes a number of chambers, integrally formed one with the other. Each chamber is provided with an opening, adapted for use as an inlet and outlet, for the entry and exit of matter into the chamber and out of the chamber. By way of example, the container can be used for carrying hair shampoo and hair conditioner, various foodstuffs which are used together or usually at the same time (such as sauces, condiments, spices and the like), or, for example, household detergents or cleaners, polishing agents, scouring agents and the like which are used at or approximately the same time. The above are however by way of example only. It should be appreciated that the invention sets out to provide an arrangement whereby at least two chambers are provided, substantially end on end, whereby products which are used at or about the same time, can be packaged, carried, stored and ultimately used in and from the same container.

Referring to the accompanying drawings, reference is first made to FIGS. 1 through 4 of the accompanying drawings. The container is shown as having a generally elongate formation, for example being of a basically circular or tubular formation. This is by way of example only however, and the container can, if desired, be of any appropriate shape or configuration. For the majority of matter however, it is advantageous for the container to be generally elongate in formation.

The elongate container 1, shown in FIGS. 1 through 4 of the accompanying drawings, is preferably formed or molded of an appropriate plastics material. Other materials can be used if desired. The container 1 is preferably molded from an appropriate plastics material into the elongate body shown, the elongate body being divided into two integrally formed, separate and end on end chambers. Preferably, these are an upper chamber 2 and a lower chamber 3.

In a preferred form of the invention, the container 1 is molded or formed into the upper and lower chambers 2 and 3, for example by an appropriate wedge (not shown) being provided or placed into a mold or die, during formation of the container. The wedge extends substantially through the body of the container, so that a mouth portion 10 is formed extending into the container 1, from a front face thereof. The mouth 10 is formed by upper and lower surfaces 10A and 10B which extend rearwardly to be adjoined to an integrally formed rear joint or wall 7 of the mouth 10 and container 1. Upper and lower surfaces 10A and 10B of the mouth portion 10 define respectively lower and upper walls to the upper and lower chambers.

Figure 3:
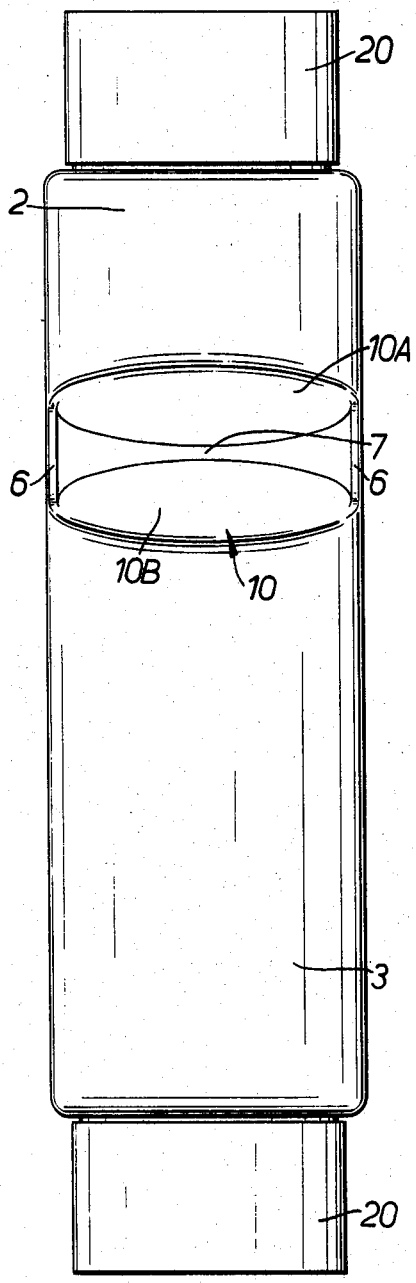
FIG. 3 is a front elevational view of the container of FIG. 1.
Figure 4:
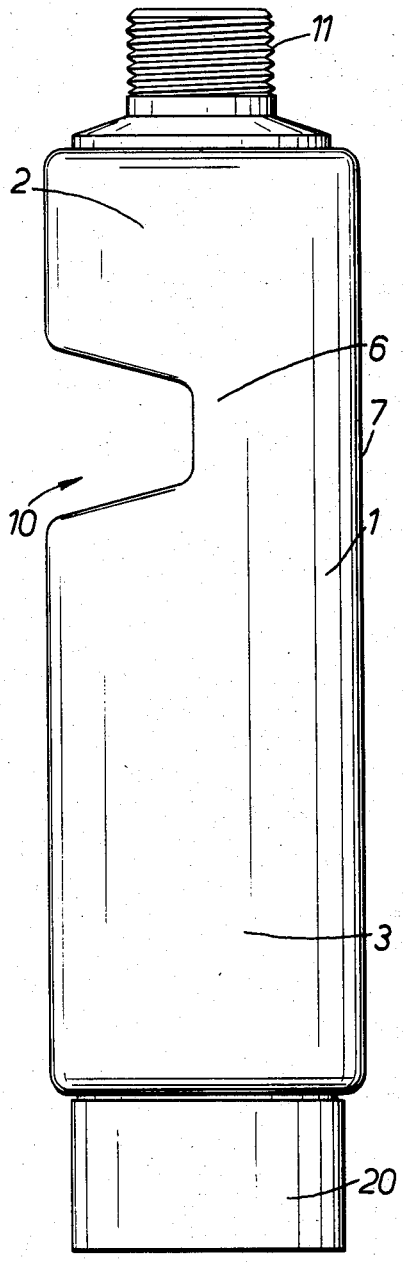
FIG. 4 is a right side view of the container as shown in FIG. 3 with the upper cap removed.

In one form of the invention, as shown in particular in FIG. 3 of the drawings, the upper and lower walls 10A and 10B are angled downwardly and upwardly respectively, towards each other, so that they terminate at the rear wall or joint 7 in a substantially spaced apart orientation. The container is also formed so that it is provided with side webs or gussets 6, which define sides to the mouth portion 10 and extend rearwardly from the open face thereof, to be integrally formed with the rear wall or joint 7, as referred to hereinbefore.

Thus, the mouth 10 when formed in the body portion, serves to effectively separate the chambers 2 and 3 one from the other, in a substantially end on end formation (one above the other) while the side webs 6 and rear wall or joint 7, which are integrally formed into the container, serve to connect and hold the chambers 2 and 3 together; the side webs 6 assist also and add strength and support to the connection between the upper and lower chambers 2 and 3.

The formation of the mouth 10 is aesthetically pleasing, and while it serves to separate the upper and lower chambers 2 and 3 one from the other, it also serves to provide a grip portion for handling. Primarily however, the mouth 10 provides an effective and aesthetically pleasing means whereby the integrally formed chambers 2 and 3 can be separated one from the other. As referred to hereinbefore the upper and lower walls 10A and 10B of the mouth 10 serve to define and provide the lower and upper walls of the upper and lower chambers 2 and 3 respectively.

In a preferred form of the invention as shown in FIGS. 1 through 4 of the accompanying drawings, each chamber is provided with a separate opening 11, such as a screw threaded inlet/outlet, appropriate screw threaded caps or engagement means 20 also being provided for engagement therewith. Thus, the separate openings allow for the separate entry of matter into and out of each chamber 2 and 3. This is however by way of example only, and it will be appreciated that any appropriate means of inlet/outlet for each chamber 2 and 3 can be provided. In addition, it should be appreciated that other forms of openings or closures can be provided; for example pouring lips, clip-on caps or snap-on caps. These are by way of example and other means known in the art or readily available at this or any future time can be used.

Referring again to FIGS. 1 through 4 of the accompanying drawings, it will be seen that the chamber 1 is an elongate chamber which is divided into two chambers 2 and 3. The upper chamber 2 is of a smaller size and area than the lower chamber 3. Thus, when the container 1 is formed and molded, a wedge (not shown) is so positioned that the upper chamber 2 is of such a lesser size than, and relative to, a larger lower chamber 3. If desired, the container 1 can be molded so as to have more than two chambers; alternatively, the sizing of the chambers can be varied. For example a further form of the invention will be described hereinafter, with reference to FIGS. 5 and 6 of the accompanying drawings.

In the arrangement of FIGS. 1 through 4 of the drawings, this particular arrangement is particularly advantageous for use with hair treatment preparations, such as for example hair shampoo and hair conditioner. It has been found that it is particularly useful to combine these two products one with the other, in the same container, especially for sports people, travellers and the like. Thus, when a person wishes to wash their hair (such as after a game or sport, during travelling, or indeed in a home or bathroom situation), only one container need be used. Preferably, the container 1 is formed so that the upper chamber 2 is smaller than the lower chamber 3, in that people generally speaking require a smaller amount of hair conditioner relative to an amount of hair shampoo. Thus, hair conditioner is inserted into the smaller upper chamber 2, while shampoo is placed into the larger or lower chamber 3. Thus, a combination of hair conditioner and hair shampoo is provided in one container, but the two products are separated one from the other. Thus, they are carried in one container.

In use therefore and referring by way of example to a person washing their hair, the container 1 can be gripped (such as for example using the grip portion or mouth 10), and a top 20 can be taken off a lower chamber 3, containing shampoo. The shampoo is then used and the cap replaced or the opening closed. Once the shampoo has been washed out of the hair, the cap 20 can be removed from the upper and smaller chamber 2 (containing conditioner) and an amount of conditioner exited therefrom. The cap 20 is then replaced or the opening closed. The hair can then be subject to conditioner.

It should be appreciated that there are real advantages in providing many products within the single container. In particular, the provision of two products in a single container avoids the need for people to take up one product, replace it and then take up another product. In addition, it means that a person washing their hair can carry the same container while applying shampoo; thereafter close the container while still holding it, and, when it is desired to apply conditioner to the hair, conditioner can be exited from the same container which can then be placed in its position of rest, such as for example on the edge of a bath, in a shower casing or cabinet, or on a bathroom shelf and the like.

In a further form of the invention, with reference to FIGS. 1 through 4 of the accompanying drawings, a similar container can be used, for example for containing a number of pharmaceuticals or medicinal products which may be used at the same time. In a further form of the invention, it is envisaged that for example a suntan oil and a cream could be carried in the container of the present invention; where one chamber 2 is smaller than the other chamber 3, matter placed into the smaller chamber will be that matter which one uses less than the matter placed into the chamber 3. In yet a further form of the invention, it is envisaged that the present invention can be used for carrying foodstuffs, condiments or sauces. In yet a further form of the invention it is envisaged that the container of the present invention can be used to advantage to carry bleaching, cleaning, scouring or polishing compounds which might be used at or about the same time. Again, it should be appreciated that if there is one product which is used substantially less than another product, then the product that is used to a lesser extent can preferably be inserted into the area of smaller size or dimensions.

Figure 5:
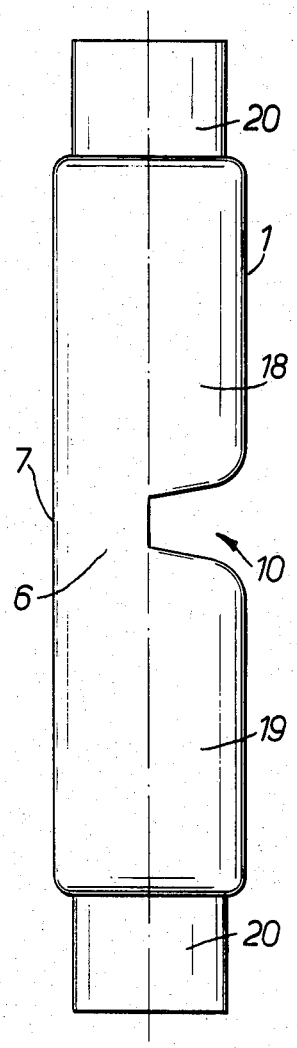
FIG. 5 is a side elevational view of a container according to a further form of the invention.
Figure 6:
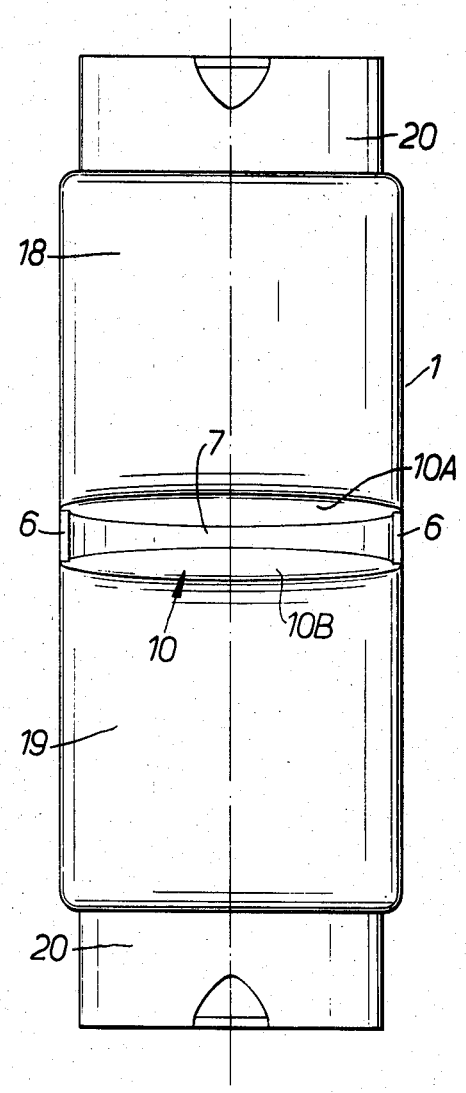
FIG. 6 is a front view of the container as shown in FIG. 5.

Referring now to the further form of the invention shown in FIGS. 5 and 6 of the accompanying drawings.

In this form of the invention, the container is an elongate container 1 which is divided into upper and lower chambers 18 and 19, the chambers 18 and 19 being of substantially the same size and area, so that substantially the same amount of matter can be inserted into each of the chambers 18 and 19. The chambers 18 and 19 are preferably provided one above the other, and are substantially co-axial one with the other, as are the chambers 2 and 3 in the arrangement shown with reference to FIGS. 1 through 4 of the accompanying drawings.

The chambers 18 and 19 are preferably at least partially separated one from the other, by means of a mouth portion 10 and as in other forms of the invention, the upper and lower walls 10A and 10B of the mouth portion 10, together with the side webs 6 (and the adjoining rear wall 7), serve to separate the upper and lower chambers 18 and 19 one from the other, while at the same time giving strength and rigidity to the container as a whole. The upper and lower surfaces 10A and 10B of the mouth portion 10 also define the lower and upper walls of the upper and lower chambers 2 and 3.

In the form of the invention shown in FIGS. 5 and 6 of the accompanying drawings, each chamber 18 and 19 is provided with a separate opening, to allow for the inlet of matter into and the exit of matter out of, the container. Appropriate closure means or caps 20 are also provided so as to engage with or over the one or more openings referred to.

In use, it is considered that it will be advantageous to use the form of the invention shown with reference to FIGS. 5 and 6 of the accompanying drawings, for carrying foodstuffs, sauces, drinks or condiments and the like which may be used at or about the same time. For example, two types of different sauces could be carried, one in each chamber; alternatively, different spices, herbs or the like. It should be appreciated, that these however are by way of example only.

In yet a further form of the invention it is envisaged that a container of the present invention, as shown with reference to any one of the accompanying drawings, could also be used for drinks, liquid foodstuffs, cosmetics, pharmaceuticals, medicaments, cleansers, polishes, and the like.

Thus, it will be appreciated that the present invention provides a container which includes at least two end on end containers, one above the other, in such a manner that any and all matter which is used at or about the same time, can be contained separately within each chamber, while being contained within the same overall container for the purposes of packaging, purchase, carrying, storage and use. The invention has been described by way of example, with reference to the chambers 2, 3 and 18, 19, being substantially co-axial. This is by way of example, and if desired the chambers can be off set realtive to each other. It should be appreciated that modifications and improvements may be made to the invention without departing from the scope or spirit thereof, as defined by the appended claims.

I claim:

1. A container comprising: at least two integrally formed but separate chambers; at least one chamber being above another to produce upper and lower chambers; a separate opening for each chamber; said chambers being separated one from the other by a mouth portion defining an at least partial spacing between said chambers; said mouth portion defining an open face between adjacent ends of said chambers and a rear joining wall of said container and having upper and lower faces defining, respectively, lower and upper ends of said upper and lower chambers.

2. A container as claimed in claim 1, wherein said mouth portion is further defined by side webs extending between said adjacent ends of said chambers.

3. A container as claimed in claim 1, wherein said chambers are substantially the same size.

4. A container as claimed in claim 1, wherein one of said chambers is of a greater size than another chamber.

5. A container as claimed in claim 1, and further comprising: a generally elongate body portion; said chambers being substantially co-axial; and closure means for use with each of said separate openings.

6. A container as claimed in claim 4, wherein: said chambers are substantially co-axial; and closure means are provided for use with each of said openings.

7. A container as claimed in claim 3, wherein: said chambers are substantially co-axial; and closure means are provided for use with each of said openings.

* * * * *